US006499419B1

(12) United States Patent
Bussard

(10) Patent No.: US 6,499,419 B1
(45) Date of Patent: Dec. 31, 2002

(54) HYDROFOIL WING SYSTEM FOR MONOHULL KEEL BOAT

(75) Inventor: Robert W. Bussard, 9705 Carroll Center Rd., Suite 103, San Diego, CA (US) 92126

(73) Assignee: Robert W. Bussard, San Diego, CA (US)

( * ) Notice: Subject to any disclaimer, the term of this patent is extended or adjusted under 35 U.S.C. 154(b) by 0 days.

(21) Appl. No.: 09/771,110

(22) Filed: Jan. 26, 2001

Related U.S. Application Data

(60) Provisional application No. 60/177,650, filed on Jan. 27, 2000.

(51) Int. Cl.[7] ..... B63B 1/24

(52) U.S. Cl. ..... 114/274; 114/280; 114/282

(58) Field of Search ..... 114/39.21, 39.24, 114/271, 274, 275, 277, 278, 280, 282

(56) References Cited

U.S. PATENT DOCUMENTS 2,856,879 A * 10/1958 Baker ..... 114/39.24
3,373,710 A * 3/1968 Steinberg ..... 114/39.24
3,693,570 A * 9/1972 Erlykin et al. ..... 114/274
3,995,575 A 12/1976 Jones, Jr. ..... 114/56
5,636,585 A 6/1997 Schulz ..... 114/123
5,988,097 A 11/1999 Karney et al. ..... 114/283
6,032,603 A 3/2000 Olcott ..... 114/140

OTHER PUBLICATIONS

Lawrence J. The Foil–Stabilized Super–Slender Nov. 19, 1999 Sydney, NSW 2052, Australia Doctors Monohull.

* cited by examiner

*Primary Examiner*—Stephen Avila
(74) *Attorney, Agent, or Firm*—Foley & Lardner

(57) ABSTRACT

A monohull keel sail boat is provided with a bow foil structure, a keel foil structure and a stern foil structure. The bow, keel and stern foil structures have foils with may be moved to provide a variable angle of attack and thus variable lifting forces. The stern foil structure has a ladder foil arrangement and includes vertical struts to provide steering control thus replacing a conventional rudder. The three foil structures work in concert to lift the hull of the boat, but not the keel, completely out of the water so as to provide near listless sailing.

20 Claims, 12 Drawing Sheets

AMIDSHIPS VIEW

BOW VIEW

STERN VIEW

HYDROFOIL WING SYSTEM FOR MONOHULL KEEL BOAT

REFERENCE TO PROVISIONAL APPLICATION

This application claims the benefit of U.S. Provisional Application No. 60/177,650, filed Jan. 27, 2000.

FIELD OF THE INVENTION

The invention is in the field of hydrofoils for sailing vessels and is particularly directed to hydrofoils for monohull keel boats.

RELATED ART

Many sail vessels are known in the art that adopt some sort of foil system for improving stability and/or performance of the sailing vessel. Generally such hydrofoils are utilized in multi-hull designs and in some cases monohull designs.

A hydrofoil, or more simply, a foil is a streamline body designed to give lift and is similar to aircraft wings. The foil generally has a different curvature or camber at opposed surfaces thereof. The angle of attack (AoA) of a foil is the angle between the chord, defined as the straight line connecting the leading and trailing edge of the foil, and the direction of movement of the boat. Foils are designed to have a controllable AoA to achieve the desired lifting forces in various types of water and boat speeds, loads wind conditions etc. Many types of adjustment mechanisms are know for adjusting and controlling the AoA as explained, for example, in U.S. Pat. Nos. 3,995,575 and 6,032,603 the whole of which documents are incorporated herein by reference. The art also teaches the use of retractable hydrofoils which me be raised and lowed into the water as desired as, for example, illustrated in U.S. Pat. Nos. 5,636,585 and 5,988,097 incorporated herein by reference. Control of hydrofoils may be done manually or by computer control as shown in U.S. Pat No. 5,988,097.

Foils have typically be used on boats to reduce drag and to maintain trim in planing vessels. Foils are generally not used for steering nor for yaw and pitch control. A foil design has been shown for monohull keel boats as represented by U.S. Pat. No. 6,032,603 incorporated herein by reference. However, a full versatile foil system for monohull keel boats has not been developed.

SUMMARY OF THE INVENTION

Embodiments of the invention are directed at improving a conventional monohull sailing vessel having a normal keel but providing the vessel with a plurality of foils for stabilizing, steering and lifting the vessel to achieve sailing without heeling of the vessel. The hydrofoils utilized in accordance with embodiments of the invention lift the hull of the boat completely or nearly completely out of the water to take advantage of reduced drag and consequent improved speed. At the same time, the boat takes advantage of the large mass of the keel to enhance stability and prevent permanent capsizing of the boat.

Thus, embodiment of the invention employ hydrofoils for both lift and stability; for control of lift; and for three-axis control of the pitch, yaw, and roll motions of such boats in open ocean sailing.

DETAILED DESCRIPTION OF PREFERRED EMBODIMENTS

Figure 1:
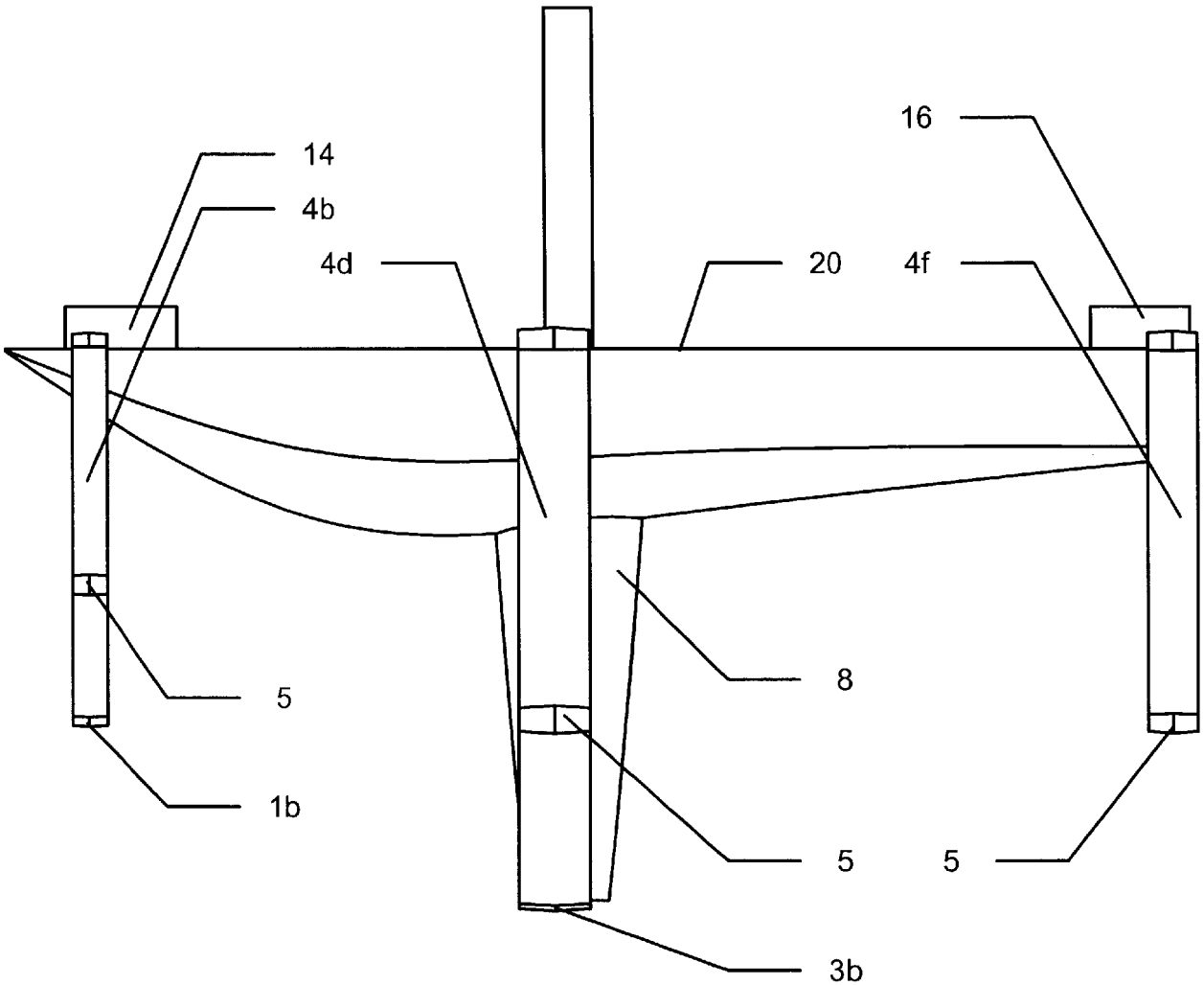
FIG. 1 illustrates a side view of an embodiment of the invention.
Figure 2A:
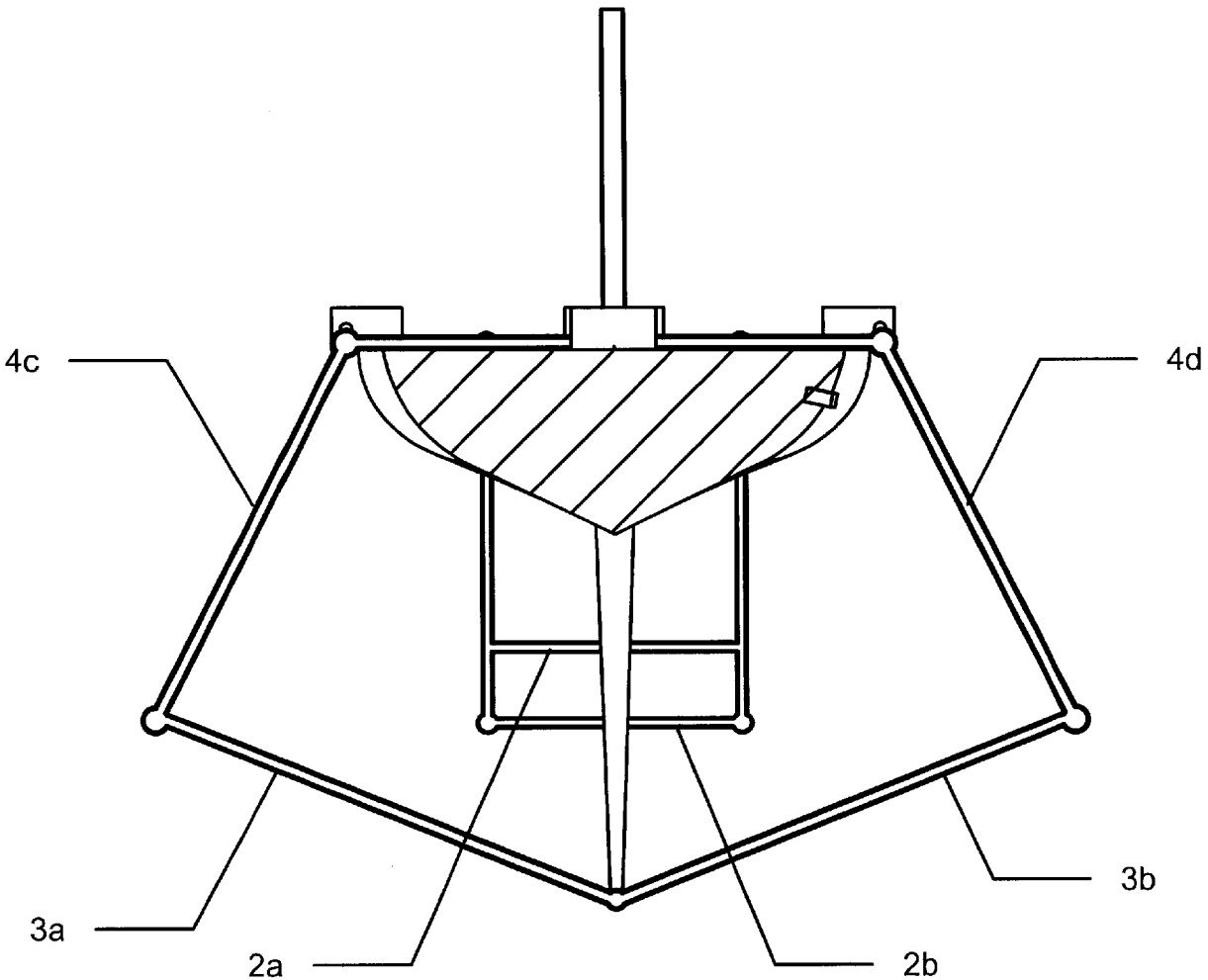
FIGS. 2*a* illustrates a cross section view of the embodiment of the invention along the amidship section of the boat.
Figure 2B:
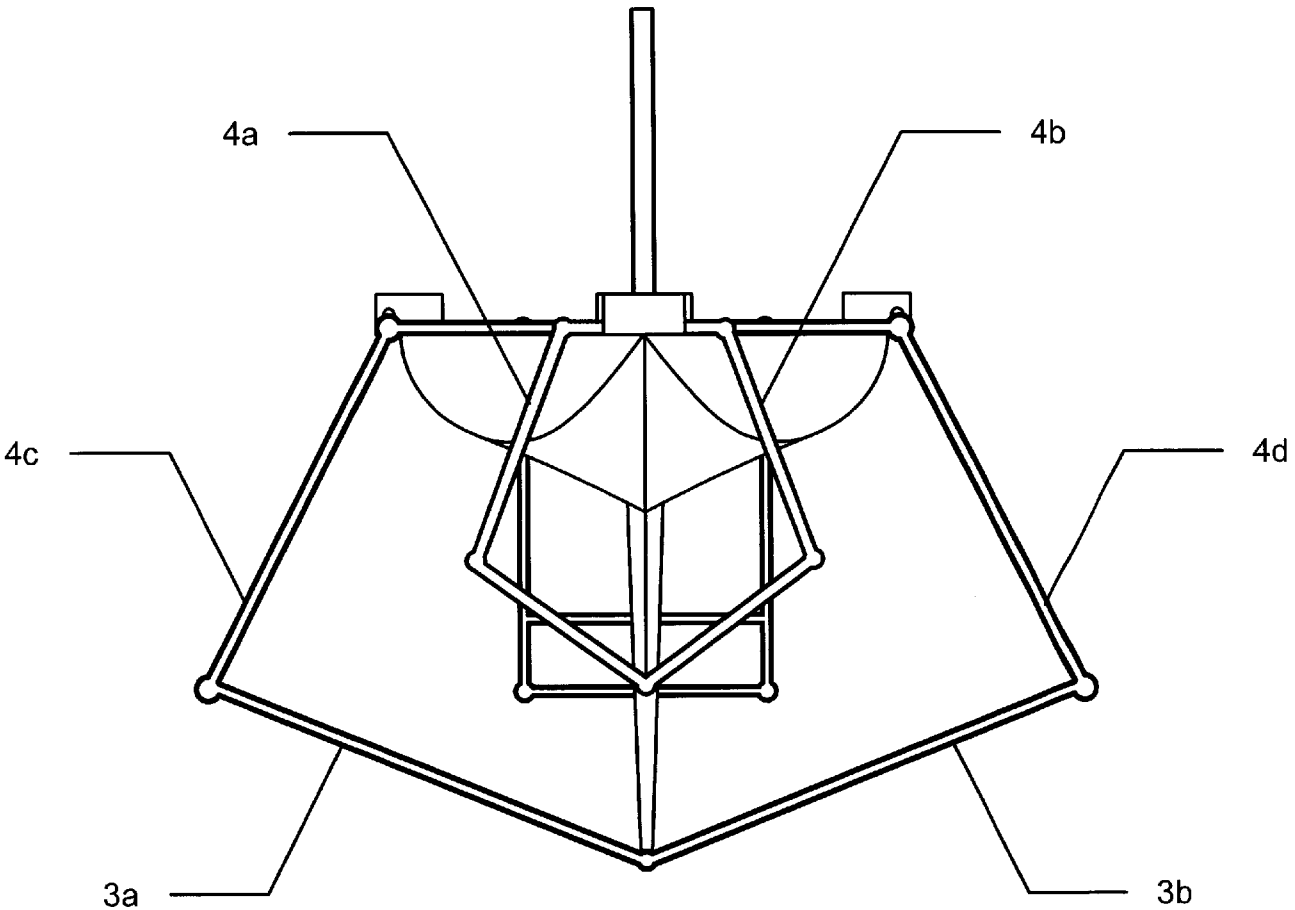
FIG. 2*b* shows an end bow view of the boat.
Figure 2C:
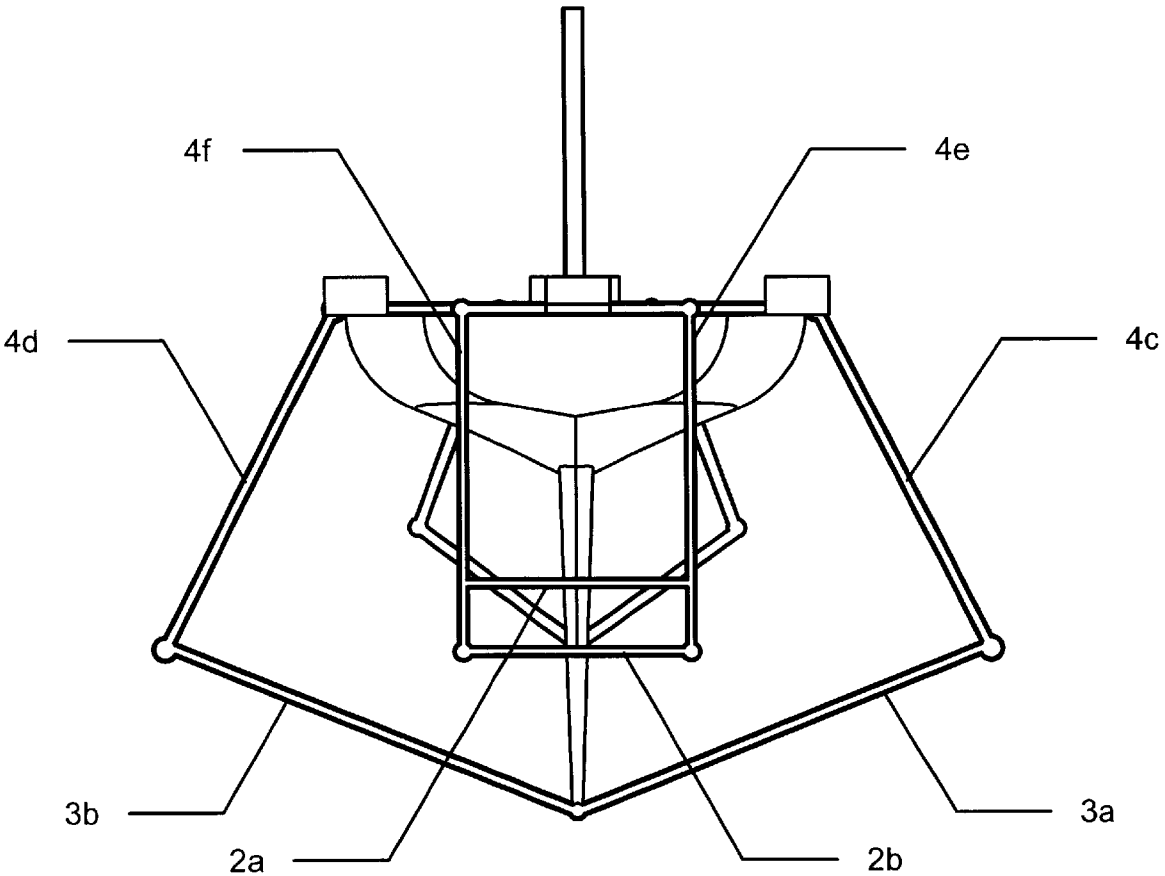
FIG. 2*c* shows an end stern view of the boat.

FIGS. 1–10 illustrate embodiments of the invention in which three separate sets of foils are secured to a boat 20 having keel 8. In the embodiments of FIGS. 1–8 the three sets of foils are bow foils 1*a* 1*b*, stern foils 2*a*, 2*b* and amidship foils 3*a*, 3*b*. The bow foils 1*a* 1*b* are configured as Vee foils; the stern foils 2*a* 2*b* are configured as ladder foils and the amidship foils 3*a* 3*b* are configured as planer foils as representative and non-limiting examples. Each set of foils is secured to the boat 20 by means of struts which are connected to the corresponding foils by foil mounting connectors 5. The other end of each of the strut is connected via strut mounting connectors 6 to structures 7 fixed to the boat deck. For example, struts 4*a*, 4*b* connect to bow foils 1*a*, 1*b* respectively; and struts 4*c*, 4*d* connect to amidship foils 3*a*, 3*b* respectively. Struts 4*e*, 4*f* connect to each of the stern foils 2*a*, 2*b*.

Figure 6:
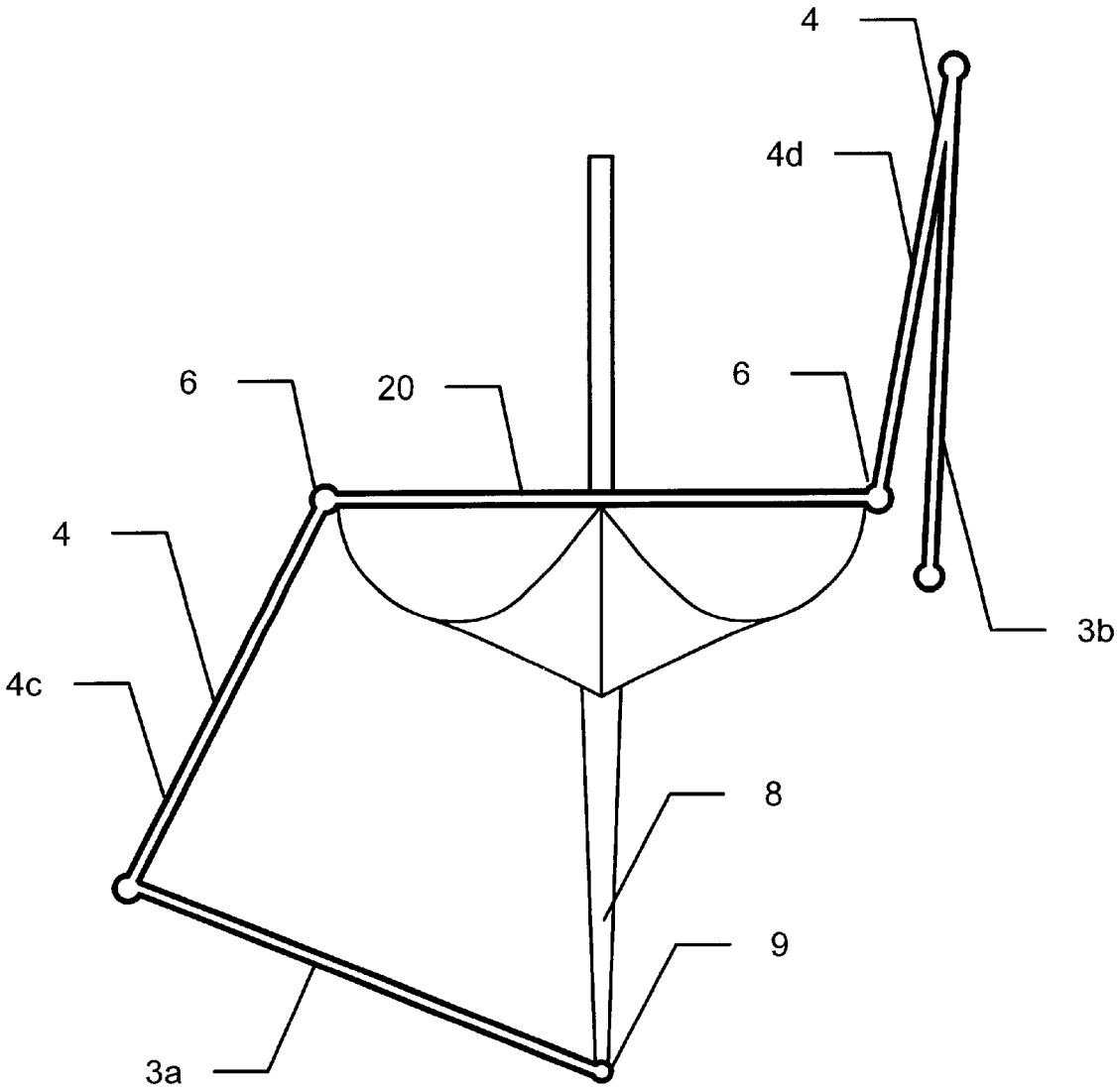
FIG. 6 shows an embodiment of the invention showing an elevated amidship foil.

As best seen in FIG. 6, the amidships foils 3*a*, 3*b* are connected to keel 8 (and in turn to each other) by means of a locking connector 9. The locking connector may be controllably released by means of a cable passing through or attached outside of the keel. Alternatively, a wireless remotely controlled system may be employed to open and close locking jaws which attach to the keel ends of the foils 3.

Figure 3:
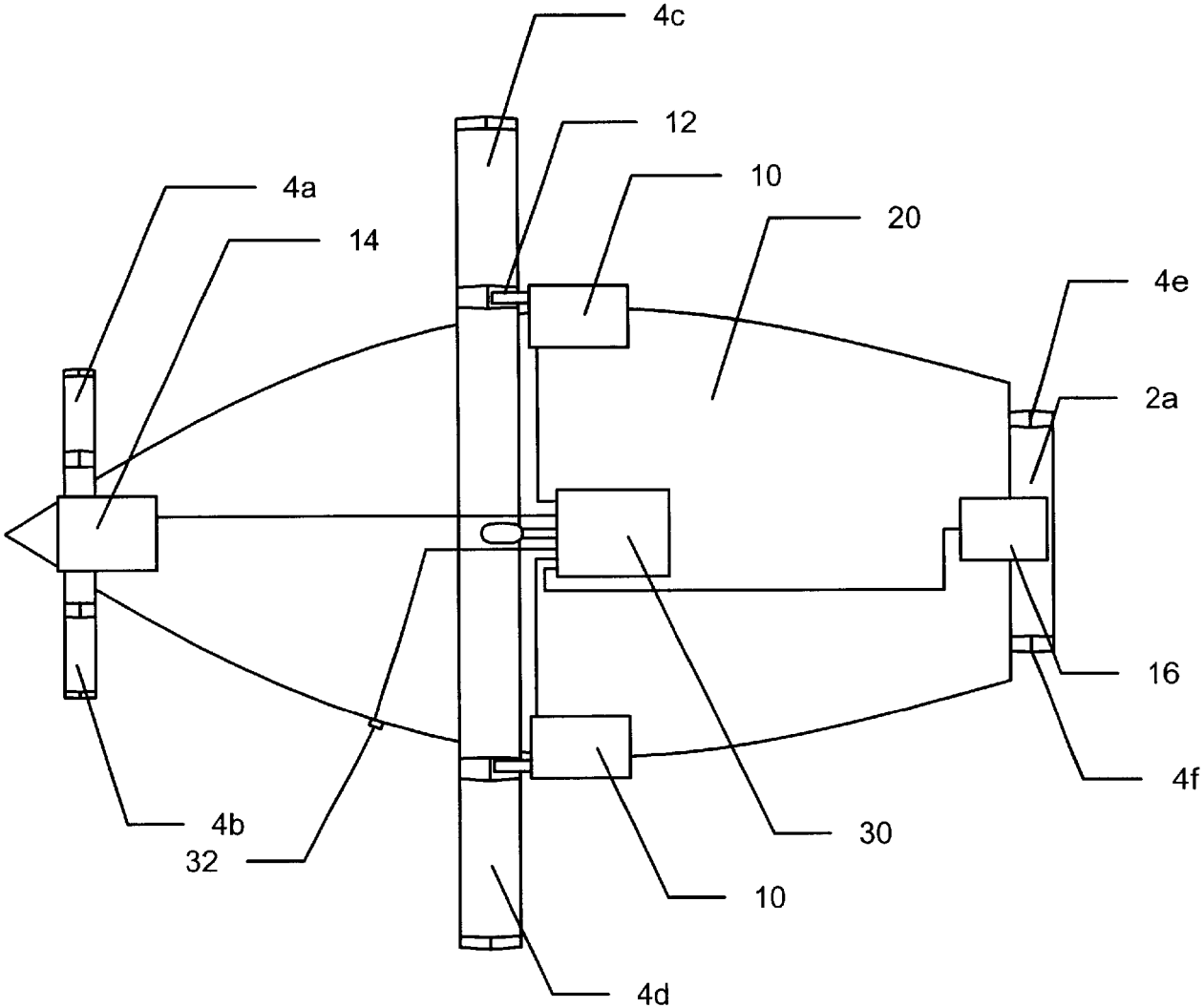
FIG. 3 is a plan view of the embodiment of the invention.
Figure 5:
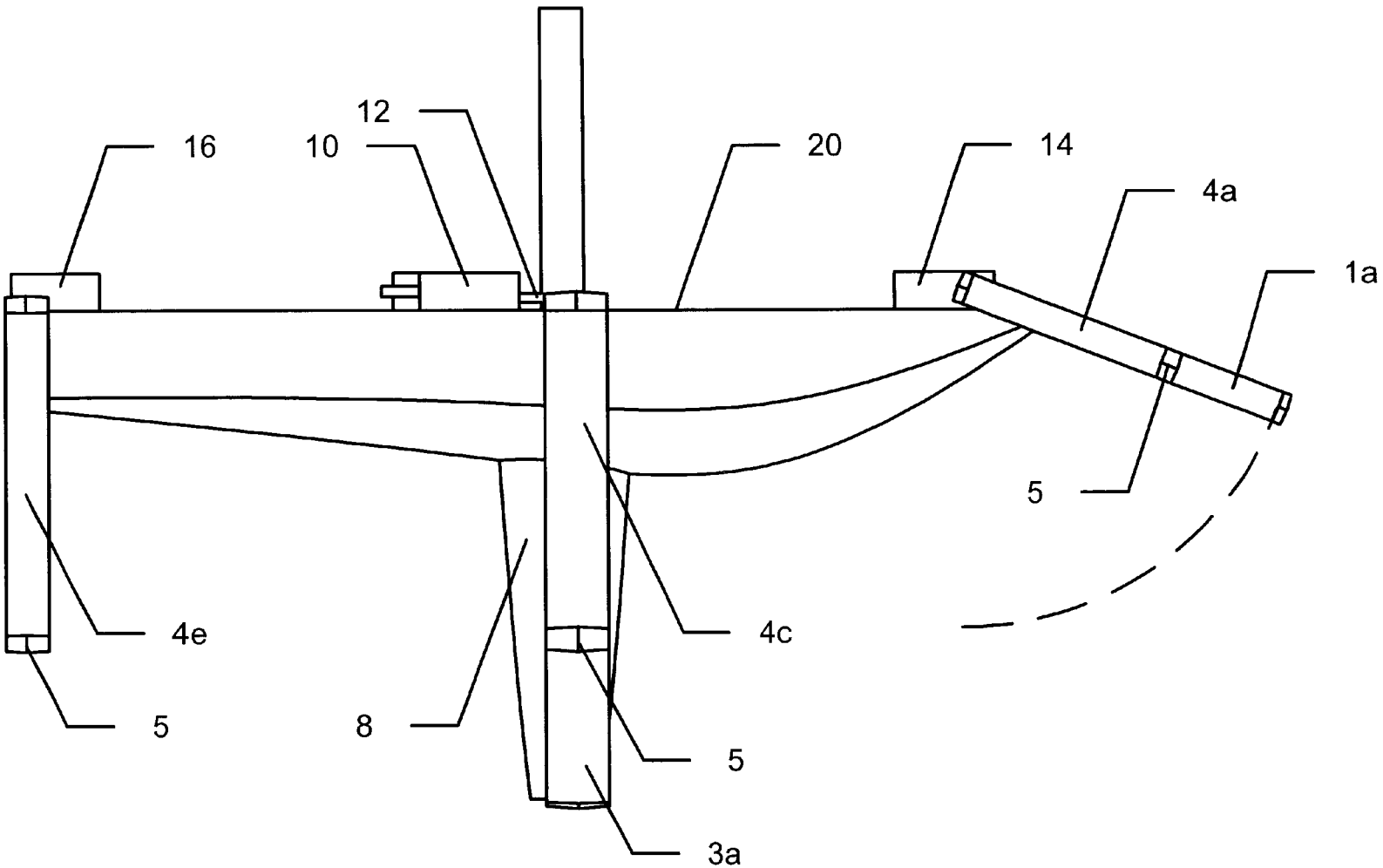
FIG. 5 is a side view of an embodiment of the invention showing an elevated bow foil.

The amidship foil 3*a* 3*b* may be pivoted upward and completely out of the water. For ease of illustration only one such foil 3*b* and corresponding strut 4*d* is shown in the raised position as shown in FIG. 6. Pivoting may be achieved by means of a motor 10 having a shaft 12 connected to the pivot axis of the struts as seen in FIGS. 3 and 5. The motor 10 is omitted from FIG. 6 and other figures for clarity. It is understood that there are two such motors 10, one for each of the amidship foils 3. These motors may be independently controlled or controlled to operate at the same time and manner or in a coordinated manner by means of a controller 30. Alternatively, a simple mechanical crank (shown as C in FIG. 3) may be provided and manually operated to lift and lower the amidship foils 3*a* 3*b* together with their connecting struts 4*c*4*d*. A separate crank may be provided for lifting and lowering each of the other foils 1*a*, 1*b*; and 2*a*, 2*b* together with their corresponding struts.

If manual cranks are not employed, another motor 14 may be used to pivot the bow foils 1*a* illustrated in FIG. 5, and a third motor 16 may be used to pivot the stern foils 2 in a similar fashion as the bow foils 1. FIG. 5 shows the bow foils fully stowed and the stern foils 2 in their fully deployed position.

Controller 30, as for example a microprocessor may be used to coordinate the deployment of each of the foils according to a desired optimal configuration for the particular boat and sailing conditions. The controller may receive control signals input from sensors measuring boat angle, speed, height above water, pressure sensors or other conditions. One such sensor is illustrated as element 32 in FIGS. 3 and 4. Alternatively, each of the two motors 10 and the motors 14 and 16 may be individually controlled by means of manually turning on and off the motor at the desired times.

The bow foils 1*a*, 1*b* may be configured to have their AoA individually adjusted. Similarly, the amidship foils 3*a*, 3*b* may have their AoA individually adjustable. It is not necessary to adjust the AoA of the struts 4*a*, 4*b*, 4*c* and 4*d*, so these struts are fixed. However, the struts 4*e*, 4*f* may be ganged together and are moveable about their vertical axis and indeed serve the function of a rudder and may replace the conventional rudder. The stern ladder foils 2*a*, 2*b* are also ganged together but may be controlled to have a variable AoA.

Figure 7:
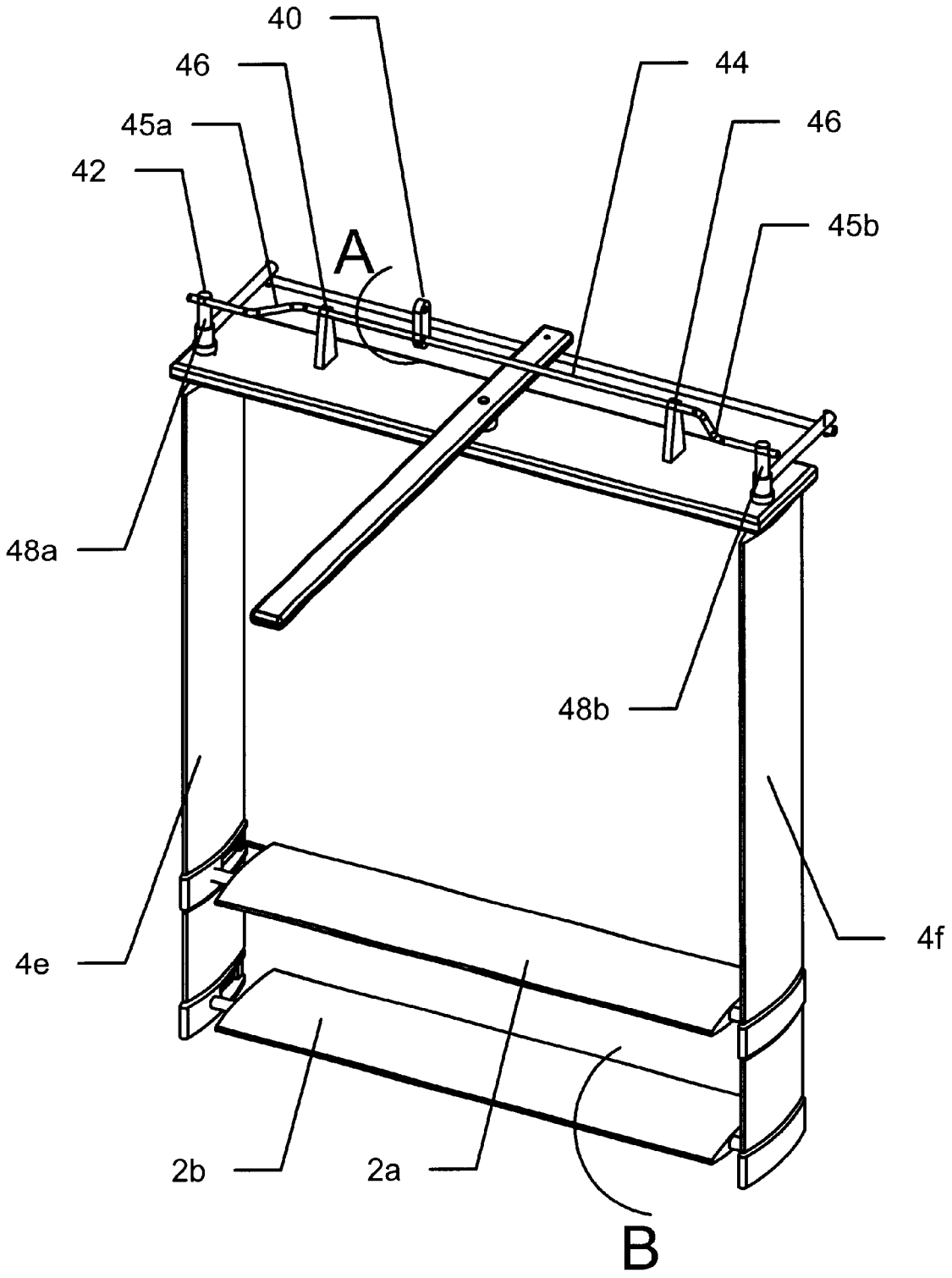
FIG. 7 is an enlarged perspective view of the stern foil showing an example of the linking mechanism for controlling the ladder angle of attack.
Figure 8:
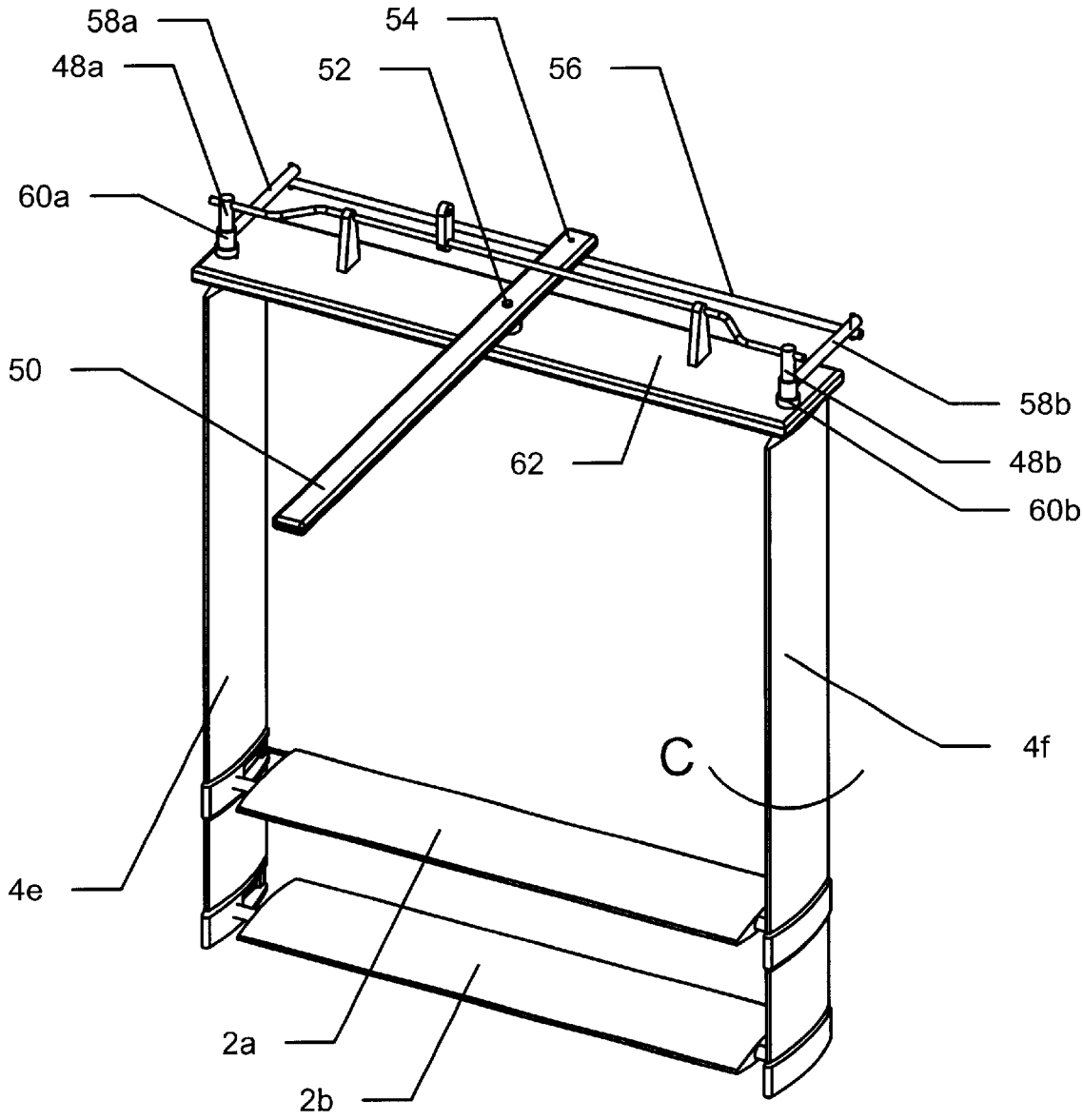
FIG. 8 is an enlarged perspective view of the stern foil showing an example of the linking mechanism for controlling the struts which act as rudders.

FIGS. 7 and 8 show the stern foils and struts in greater detail. In FIG. 7, there is illustrated ladder control arm 40 and ladder push rods 42. Ladder control arm 40 is positioned on a push rod 44 supported on post 46, and is rotated back and forth in the direction of the arrow A to control the AoA of the stern foils 2*a*, 2*b*. Push rod 44 is bent at ends 45*a* 45*b* so that rotation of the push rod 44 causes vertical rods 48*a* 48*b* to be raised and lowered to control the foils 2*a*, 2*b*. The vertical rods 48*a*, 48*b* are passed through each of the struts 4*e*, 4*f* and connect to the respective foils 2*a*, 2*b* to cause them to rotate or tilt in the direction of the arrow B shown for foil 2*b* as an illustrative example. As indicated above, the two foils 2*a*, 2*b* are ganged together so that they may be tilted as a single unit. Moving the control arm 40 in one direction of arrow A causes a positive angle of attack for the foils 2*a*, 2*b* and movement in the opposite direction causes as negative angle of attack (assuming the foils are initially positioned at a zero AoA).

FIG. 8 illustrates the bow foils structure showing the rudder control. A tiller 50 is pivoted about pivot point 52 and connected at one end 54 to a rudder control linkage 56 and through respective links 58*a*, 58*b* to axial end members 60*a*, 60*b*. These axial end members 60*a*, 60*b* connect through a short extension axial to the struts 4*e*, 4*f* to cause the to rotate in the direction of the arrow C to serve as a rudder controlling boat direction. Is it to be noted that in the disclosed embodiment, the vertical rods 48*a*, 48 used for foil control pass through the short axial end members 60*a*, 60*b* and connected axis (not shown) which are hollow and permit passage of the vertical rods 48*a*, 48*b* to the foils 2*a*, 2*b*. Clearly, axial end members 60*a*, 60*b* may alternatively be constructed as solid members with the vertical rods 48*a*, 48*b* extending through a separate aperture in upper support plate 62 and down through the hollow or semi-hollow struts 4*e*, 4*f* to connect to the foils 2*a*, 2*b*.

Alternative to the arrangement shown in FIG. 8, the struts 4*e*, 4*f* may be fixed and the shown foil/strut arrangement may be used together with a conventional rudder.

Figure 9:
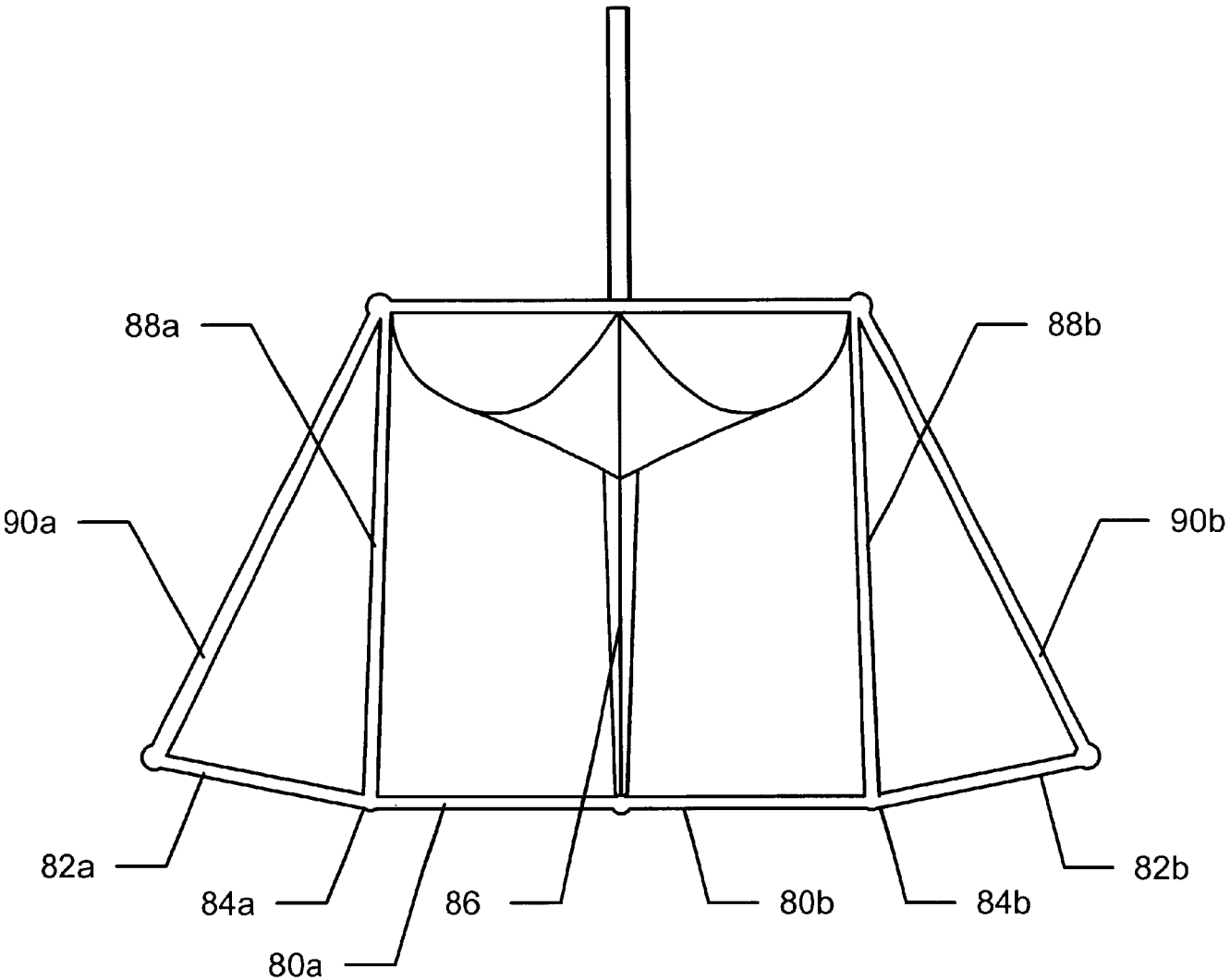
FIG. 9 illustrates another embodiment of the foils attached to the keel including keel foils and outbound foils.
Figure 10:
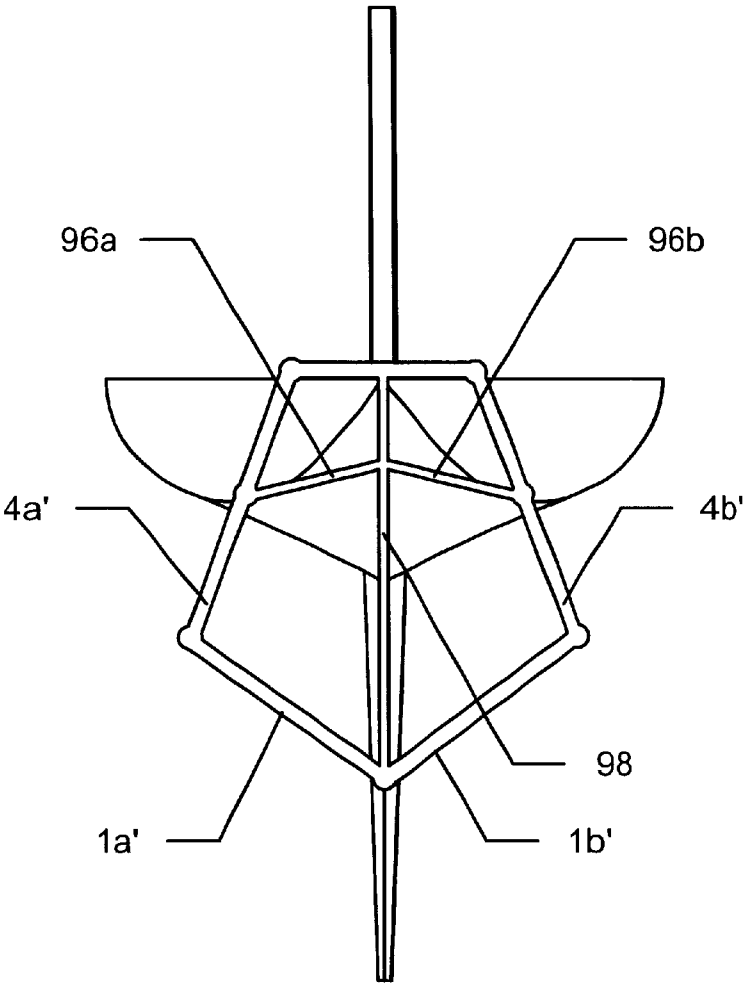
FIG. 10 illustrates an alternate embodiment of a bow/stern foils system.

FIGS. 9 and 10 show other embodiments of the amidships and bow/stern foil/strut structure. In FIGS. 9 shows the amidships foil/strut structure and is seen to comprise a amidship foils 80*a*, 80*b* (port and starboard) which are connected to additional foils in the form of outboard foils 82*a*, 82*b* by means of connectors for releasably connecting the foils. The amidships foils 80*a*, 80*b* are connected at their other ends to keel 86. Vertical struts 88*a*, 88*b* connect to connectors 84*a*, 84*b* respectively and outboard struts 90*a*, 90*b* connect to the distal ends of outboard foils 82*a*, 82*b*. In this embodiment, the AoA of the foils 80*a*, 80*b* and 82*a*, 82*b* may each be independently adjusted through motorized or strictly manual (cranks and gears) means. In FIG. 9, the struts 90*a*, 90*b* and outboard foils 82*a*, 82*b* may be pivoted completely out of the water after mechanically releasing the foils 82*a*, 82*b* from the connectors 84*a*, 84*b*. Alternatively, the vertical struts 88*a*, 88*b* may be rotated out of the water together with the outboard struts 90*a*, 90*b* and outboard foils 82*a*, 82*b*. Mechanical linkages for performing the stowing and deploying of the struts and foils may be the same or similar to those used in connection with FIGS. 1–8 and many other mechanical structures may be employed which will be apparent to one of skill in the art.

Figure 4:
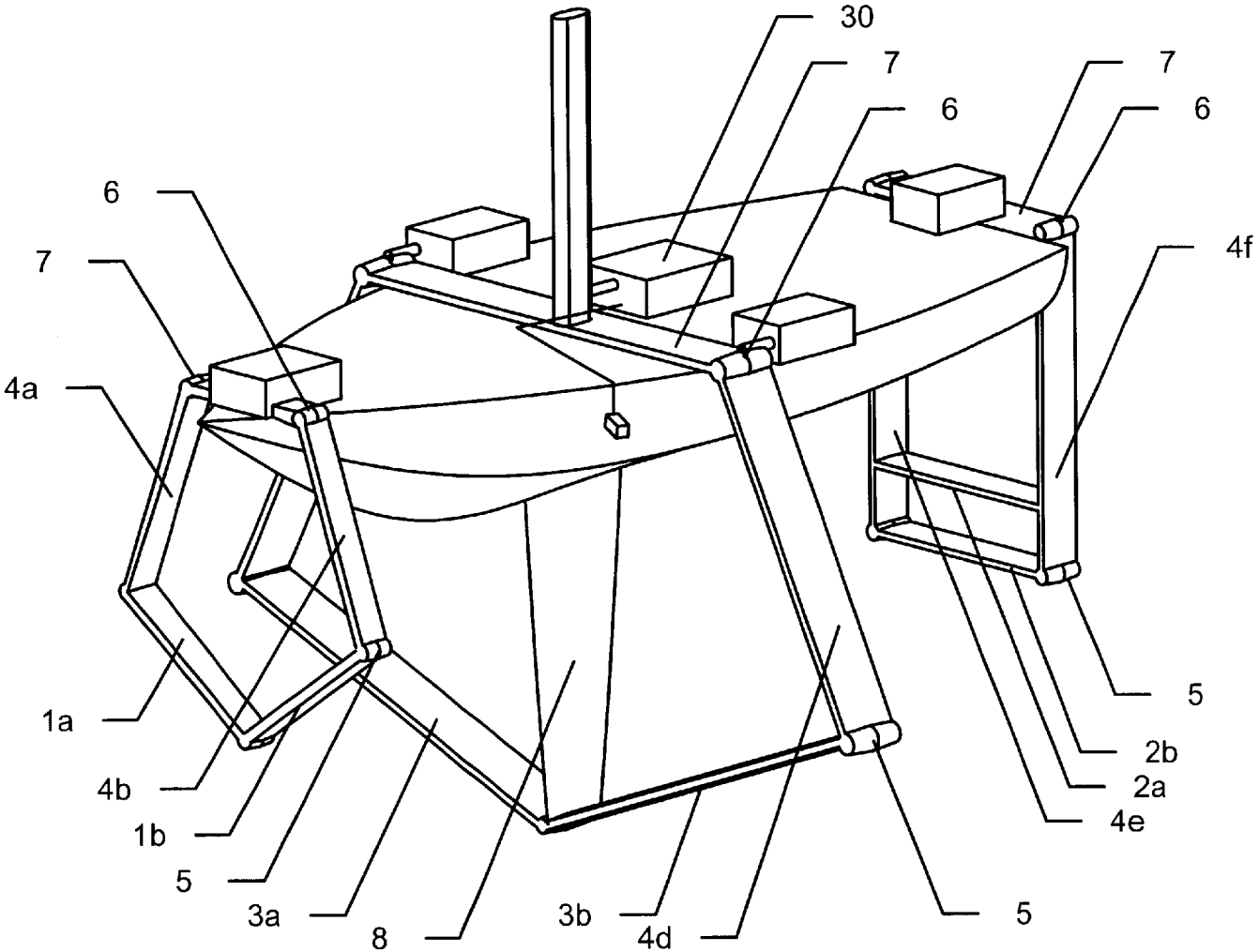
FIG. 4 is a perspective view of an embodiment of the invention.

FIG. 10 shows an alternative arrangement which may be used for either the bow or stern or both. As a bow foil system, the arrangement is similar to that shown in FIG. 4 but additionally utilizes strengthening arms 96*a*, 96*b* and central support strut 98. Otherwise, the drawing has been similarly labeled as in FIG. 4 except for adding a prime indicator to the corresponding structures of FIG. 4. It is noted that the struts 4*a*', 4*b*' in FIG. 10 are substantially vertical whereas the struts 4*a*, 4*b* in FIG. 4 are positioned at an angle.

The strengthening arms 96*a*, 96*b* connect to the struts 4*a*' and 4*b*' respectively and also connect to the central support strut 98. The central support strut 98 also connects at its lower end to each of the foils 1*a*', 1*b*'. In the bow foil system, the struts 4*a*', 4*b*', the strengthening arms 96*a*, 96*b* and the central support strut 98 are fixed as to their AoA whereas the foils 1*a*' 1*b*' have controllable and moveable angles of attack as in FIG. 4. Further, as in the previously described embodiments, the foil/strut system shown in FIG. 10 may be tilted completely out of the water.

As a stern foil system, the struts 4*a*', 4*b*' may be rotated to serve as a rudder in a similar fashion to the struts 4*e*, 4*f* shown in FIG. 8. In this case, the strengthening arms 96*a*, 96*b* may be made of flexible members or simple removed so as not to interfere with the rudder control achieved by the struts 4*a*', 4*b*'. Alternatively, when used as a stern foil/strut system, the struts 4*a*' 4*b*' may be fixed and rudder control may be supplied by means of a conventional rudder system.

It may thus be seen that embodiments of the invention utilize one or more of several features: (1) the use of a keel-mounted movable (with respect to angle of attack to the water flow) hydrofoil wing system to provide lift when operated at a positive angle of attack, sufficient to lift the hull clear of the water, when the other foils in use are also actively lifting; (2) the use of outboard (both port and starboard) foil systems with foils moveable into or our of the water and when positioned in the water providing a variably controlled AoA to provide both lift and stability against heeling when under way under sail power; and (3) the use of bow and stern movable foil systems to provide a means of control of boat pitch angle with respect to the sea/water surface, and/or to allow sea-surface following in long rolling swells of stable amplitude; such foils (especially the stern foil system) also to be used to enhance pointing/rudder control effectiveness.

Embodiments of the invention use the above foil systems to prevent heeling under sail force, by adjusting the angle of attack of the leeward foils so as to provide sufficient lift on their moment arm to counterbalance the heeling moment due to the sail force acting on the center of pressure of the sail system, above the deck line of the hull. This counterbalancing upward force will also act to lift the hull in the water by an amount of displacement exactly equal to the lifting force of the leeward foil system, thus reducing the effective hull displacement and associated displacement drag and wave drag of the hull.

The boat speed will thus increase, for a given sail driving force, because the hull wave drag—which varies as the fourth power of the speed—will be replaced by hydrofoil drag—which varies only as the square of the speed. At this point, the main wing foils on the keel can be given a positive angle of attack sufficient to lift the hull clear of the water, thus reducing the drag still further, allowing higher boat speed for the same sail driving force. The potential speed increase will be approximately proportional to the square root of the ratio of the foil system lift-to-drag ratio $(L/D)_F$ to the boat hull displacement weight-to-wave-drag ratio $(W/D_H)$. Typically the former might be $(L/D)_F=24$ while the latter might be $(W/D_H)=6$, thus giving a potential speed increase of SQRT(24/6)=2.

Such a boat can, of course, be sailed as a simple monohull keel boat, which is inherently always stable because of the keel. This feature allows the boat to overturn or undergo knockdowns without fear of permanent capsizing, in contrast to the case for non-keeled boats such as tri- or catamarans, which can not naturally recover from a capsize.

The central wing-keel-mounted foils extend from the center of lift of the keel outward to both sides of the boat, approximately to the width of the maximum beam. Each such wing-keel foil is mounted on an axle (which may or may not be the same for both foils) passing through the central area of the keel bulb (if such exists) or through the base of the keel itself. Each foil can be tilted fore-and-aft to control its angle-of-attack (AoA) with respect to the water, and thus to control the degree of its lifting capability. The outboard end of the foil axle, may, for example, be mounted in a bearing set into a strut (vertical strut as see elements 88*a*, 88*b* in FIG. 9 or angle struts 4*c*, 4*d* of FIGS. 1–8) extending down from the boat deck level to fix these wing foils at any desired dihedral angle, or to fix them level in a horizontal plane. AoA control may be accomplished by means of a push rod or other tilting assembly (e.g. cable) extending down from the deck level, which is controlled by mechanical levers actuated from the boat cockpit. These foils should be axle-mounted at about the 30% chord point, to assure good balance and ease of AoA control. A typical set of these foils for a 22 ft LOA sail b oat of displacement ca. 2000 lbs, might have a foil width extension (from the keel) of 3–4 feet, each, with a full chord length of about 1 foot. Total foil width (both foils) might then be 6–8 feet.

Beyond the wing-keel foils certain embodiments of the invention employ outboard port and starboard foils (see foils 82*a*, 82*b* of FIG. 9), extending outward from the ends of the wing-keel foils. These outboard foils may be mounted on a vertical strut (see struts 88*a*, 88*b* of FIG. 9) that hinges at deck level at the position of the vertical strut holding the wing-keel foils, in such a way to allow the outboard foil to pivot on an axis fore-and-aft paralleling the boat's axis. This allows the outboard foils to be pivoted up and out of the water by such rotation.

To reduce overall drag, the windward outboard foil may thus be removed from the water, as it serves no useful purpose to allow windward foil lift when underway (this would increase the heeling moment; an undesirable effect).

Each outer foil (see elements 82*a*, 82*b* of FIG. 9) may be mounted on a pivoting axle/axis that is constrained at its inner end by a bearing at the bottom of the vertical support strut, with push rod or cable control (as for the wing-keel foils) to control its AoA. This bearing point may be at the same depth level and position as the outermost bearing of the wing-keel foil. The outer end of the outward foil may be supported and constrained by a bearing in an angled strut (see struts 90*a*, 90*b* of FIG. 9) extending down from the same pivot point as that of the inner vertical strut. This outer angled strut can also have an adjustable AoA relative to the water flow, if desired, in order to provide additional lift. It may also be arranged so that sets of struts (wing-keel foil support and outer foil support) on each side of the boat can be adjusted to provide sideways forces when underway, to counteract leeway in the boat motion, as may be desired. A typical outer foil set for a 22 ft LOA keeled sailboat boat might employ foils of approximately the same size and extension as the wing keel foils, e.g. 3–4 feet extension on each side (beyond the wing keel foils) and chord length of about 1 foot.

The upward forces due to lift from these foils can be taken by a load structure extending from the foil support attachment points at deck level, from the deck edge to the mast. This load structure or frame may join the mast at a height above deck level sufficient to provide good load transfer without introducing deleterious mast bending moments. Typically the attachment height may be in the range of 2–3 feet for a 22 ft LOA sail boat, and may be higher for larger boats.

Bow and stern (fore and aft) foils are required to provide good control of boat pitch angle and, if desired, to assist in yaw (rudder) control. These foils may be either single wing foils with positive dihedral angles, or may be full V-foils which penetrate the water surface. They can be adjusted for angle of attack so as to provide lift on either or both bow and stern, for pitch control. If used as V-foils, in which increasing immersion in water depth automatically increases the (lifting) area of the submerged foil system, lift forces will automatically be increased as the boat settles deeper into the water. This can be adjusted by design and by AoA control of the foils to provide a means for sea surface following in long swells in open ocean sailing.

Furthermore, these foil systems can be mounted at approximately the deck level to a horizontal pivoting axle or hinge system so as to allow them to swing up and out of the water in a fore-and-aft rotary motion, coming to rest above decks, and thus clear of the water, itself. This allows access to the foil system structure without removing the boat from the water. Finally, these foil sets can also be arranged to pivot about their vertical axes to allow their use for pointing/rudder control, as well. Typical bow and stern foil sizes for a 22 ft LOA sail boat might have a half-width (of each foil set) of 3–4 feet, with a chord length of 0.5 feet.

With the typical foil sizes cited in the foregoing, the total foil area of a 22 ft LOA boat might be 18–24 $ft^2$. This is adequate to provide a lift of over 2000 lb. when sailed in a high AoA mode with a lift coefficient of about $C_L=1.0$ or so, at a boat speed of about 9 ft/sec (e.g. 5.5 kts). The principle of operation is to sail the boat at its minimum-drag AoA on all submerged foils, to reach its maximum speed (the "hull" speed), then to increase AoA on the leeward foils, counteracting heel, and increasing sail power and speed, and reducing hull drag by the lift imparted by the leeward foil system. Then, at the new maximum speed, to increase the AoA of the wing keel foils and the leeward and bow and stern foils so as to lift the boat further in the water, thus reducing hull drag and increasing boat speed further. Then, at new increased boat speed, to finally lift the hull out of the water and thus to sail on the foil systems alone.

Since hull speed varies as the square root of the boat length, while lift varies as foil area times the square of boat speed (for fixed lift coefficient), the maximum foil lift attainable will vary as the cube of the characteristic boat dimension (e.g. the length) if geometric similitude scaling is preserved in the foil system. Now, since boat mass tends to vary as the cube of the characteristic dimension, as well, this means that a foil system that "works" (i.e. will lift the boat) in a small size, will also work in any other larger size, so long as similitude is preserved. This then allows full testing of the concept and its principles at small scale with confidence that such test results will apply to any other larger size of boat. The situation is actually somewhat more favorable, in that larger boats tend to have higher hull speeds, because the coefficient $C_H$ in the Froude equation for hull-displacement-drag-limited speed [$V_{HULL}=C_H SQRT(L)$] tends to become larger with increasing size, a result of decreasing effect of auxiliary parasitic drag effects.

All lifting foils will be based on high-lift and high L/D foil sections as determined from NACA airfoil performance data. For example, a typical lifting foil may use a Clark Y section configuration. Vertical struts will use symmetrical foil sections of minimum drag, consistent with the need to provide adequate structural support to the foil systems below the waterline, when operating in maximum lifting conditions. Foils may be constructed from stainless steel or aluminum sheet metal, bent to provide the leading edge, and welded at the aft/trailing edge, with internal honeycomb stiffening to assure strength against buckling. In addition, they may also be filled with low density foam, to prevent water trapping internally.

It is presently contemplated that one embodiment of the invention will employ a trailerable sail boat (e.g. 22 ft O'Day or Catalina), as the base hull fit with foils designed and constructed to provide heel stability and hull lift, together with control options. In such design the foil systems may be folded, or stowed, and retro-fitted to the existing hull, so as to permit easy trailer launching, with subsequent simple deployment of the stowed/folded foil systems. Foils will be designed based on standard NACA lift/drag and lift coefficient data, and will be constructed of folded and rolled stainless steel sheeting or of aluminum sheeting or extrusions, made to conform to the desired NACA cross-sections. All joints may be welded or bolted and all structures and joining mechanisms may be designed with over-design safety factors of about 10x, to ensure survival in general cases of random variation of sea conditions.

In one embodiment, a minimum of five manual control handles may be used to control the AoA. One handle may be used for the outboard foils (ganged together); one for the fore foils (ganged together); one for the aft foils (ganged together) and one for each of the port and starboard sides of the main keel lift foils. In other embodiments, the port and starboard bow foils are independently adjustable as to their AoA and thus six handles are needed for control of the foil system.

Elementary models of the general concept and its performance for such a boat suggest that the maximum speed attainable with a 40 ft LOA boat of this type may be as much as 40% greater than the hull speed of a 75 ft LOA boat of similar configuration. Since ULDB maxi-sleds have higher hull speeds by approximately 25% than conventional cruising hull boats (higher $C_H$), a 40 ft LOA conventional hull with ASD-concept hydrofoils should run faster by 15% than a 75 ft LOA maxi-sled (e.g. Pyewacket).

Embodiments of the invention may thus be seen to contain a combination of submerged hydrofoils, mounted at the bow, stern, and amidships of a monohull keel sail boat. These foils are movably mounted on axles, such that the angles of said hydrofoils relative to the horizontal plane can be adjusted so as to provide lifting forces to the vessel from each hydrofoil, as may be desired.

Further, embodiments of the invention may be seen to comprise an arrangement of said hydrofoils as indicated in FIGS. 1–8, which show the bow foils 1 as "vee foils", the stern foils 2 as "ladder foils", and the amidships foils 3 as planar foils mounted at a cant angle relative to the horizontal plane. These structures are merely representative and other foil structures may be used.

The bow, stern and amidship foils are mounted on the struts. These struts may comprise symmetrical, low-drag air-foil cross-section structures which extend from the foil mounting points (under water) to structures attached to the vessel (on deck, for example) to carry the lifting loads of the foils. The structure 7 represents one such structure as a representative example only.

Embodiments of the invention also comprise, in addition to the foils themselves, an arrangement of principally vertical supporting struts 4 such that the struts can be turned from side to side to present an angle of attack to the flow of water past the vessel and thus provide sidewise forces to the vessel, as determined by the direction and angle of attack of these supporting struts.

Embodiments of the invention also comprise an arrangement of control arms or push rods extending from the deck-level strut supports to the submerged foils, articulated at each end so as to permit change and control of the angle of attack at each set of submerged foils independently of each other. The bow foils, stern foils and each side set of amidships foils are controllable independently of each other.

Further embodiments of the invention comprise a control system above decks so as to allow each foil control arm to be locked into a combination with any other, as may be desired from time to time. Control may be provided by either (a) hand-controlled electrical motors, hydraulic motors or mechanical linkages to each foil control arm or (b) automatic computer control of said control motors or linkages, whether hydraulic or air-operated, or electric motor driven, to control said foils in a predetermined manner, or in response to control signals derived from sensors measuring boat angle, speed, height above water, or other conditions.

The hydrofoils are such as to provide a sufficient lifting area so as to be capable of lifting the hull (but not the keel) partially or fully out of the water when operated at a high angle of attack when the boat speed has reached some minimum value. This minimum value will vary from boat to boat and depend on hull shape, length, and other design and configuration factors of the hull and boat itself. The lifting area of the foils is to be chosen so as to allow this minimum boat speed to be less than the "hull speed" of the boat (at zero foil lift conditions) as given by the standard Froude equation [Vhull=G(design factors)SQRT(LWL); where G(x) is a term set by hull shape and other design considerations, and LWL is boat length on its waterline] used in boat design. Foil lift is to be provided by all the foils acting together with principal lift from the amidships foils.

Foil operation is controlled such that neither side (port or starboard) of the amidships foils is ever to be allowed to exert a negative lift (downward force) on the vessel. Control of bow and stern foils may be allowed so as to exert negative lift from either set of foils, if required to adjust boat fore and aft trim (pitch).

Embodiments of the invention provide a control scheme such that, as the vessel is accelerated by wind force on its sails, the leeward amidships foils are placed into a positive angle of attack to resist the rolling movement supplied by the sail wind-force and—simultaneously—to provide some lift to the boat, on the leeward side of the hull. This lift reduces the "effective" displacement of the vessel, allowing the hull to lift slightly out of the water, thus reducing the hull wetted area in the water, which —in turn—reduces the hull friction drag and wave drag. These reductions in boat drag allow it to accelerate to a higher speed in the water, with the same sail/wind forces. If the boat is moving upwind, this will yield increased sail/wind forces and still further accelerate the boat. At this higher speed, the foil lift will increase further, as the square of the speed (for the same angle of attack), thus lifting the boat still further. As this process proceeds the windward amidships foil(s) and the bow and stern foils can also be placed into positive angles of attack to provide still more lift until the hull of the vessel is lifted clear of the water. At this point the boat is supported only on the submerged hydrofoils and is moving at greater speed than would be possible if operating as a normal displacement sail boat without said hydrofoils.

The hydrofoils may be constructed with cross-sections that allow high ratios (L/D) of lift (L) to foil drag (D) at optimum angles of attack, and which have very low drag at zero angle of attack. A typical foil cross-section of interest is that of the "Clark Y" airfoil (e.g., see I. H. Abbott and A. E. von Doenhoff, *Theory of Wing Sections*, Dover, N.Y., (1959) incorporated herein by reference). Such foils typically have their maximum thickness located at about 30% aft of the foil leading edge, with thickness being typically less than 10% (as low as 5–6%) of the chord length itself.

The hydrofoils and their supporting struts may be made of aluminum, or stainless steel, or fiberglass reinforced with metal tubing. All foils may be filled with foam plastic so as to exclude water from their interior and thus provide some measure of floatation and buoyancy lift.

The supporting struts of each foil set are arranged such that each complete foil system may be rotated out of the water if and when desired, to allow operation of the sail boat in a conventional manner. FIG. 5 shows one such arrangement for the bow foils in which the supporting struts are mounted on a pivot (transverse across the hull deck) at their connection point to the supporting deck structure, such that the center foil system can be rotated up above the deck surface. A locking mechanism can be provided in the strut pivot system to hold the foil in either the downward or upward position. Stern foils are to be similarly configured so as to allow their rotation above the deck level.

Amidships foils may be rotated up in their plane intersecting the vessel, from below the hull to above deck as shown in FIG. 6. Here the main support strut 4*d* rotates up and the foil pivots at its rotational joint connection to the strut, to fold upon the strut as the strut is rotated. The central foil locking connector 9 is disengaged by a mechanical disconnect to allow this rotational storage to proceed. Reinstallation of the amidships foils is accomplished by rotation and unfolding of the foils and positioning their central locking connector 9 into an automatic latching mechanism to hold each side (port and starboard) foil axle in place.

In embodiments of the invention, the amidships foils have approximately 4–6 times the lifting area of each of the bow and stern foils, while these have lifting areas approximately equal to each other. The maximum possible initial lifting area, when first starting to operate with foil lift, is thus that of the bow and stern foils plus that of the leeward amidships foil. The amidships foil typically extend to a distance from the vessel approximately twice that of the hull itself; that is, the total foil length is approximately twice the vessel's beam. The total planform lengths of the bow and stern foils are typically less than this beam. All foils are to have a combination of rectangular planform with aspect ratio of at least 6:1 and, where practicable, tip plates may be provided on one or another of the foils to enhance lifting operation.

As an example, a Lido 14 (a 14 foot monohull sail boat) with empty displacement of approximately 340 lb can be provided with such foils as follows:

Amidships foils: 6 ft (length)×10 in (chord), each side

Bow foils: 2.6 ft×5 in, each side

Stern foils: 4 ft×7 in, for one foil or 4 ft×3.5 in, for two foils (one above the other in ladder-step fashion).

The total lifting area at initial lift conditions is then one side amidships foil plus bow and stern foils=9.5 $ft^2$. If the foils have lift coefficients of cL=1.0 and lift to drag ratio of (L/D)=20:1 they are capable of providing a lift force of about 660 lb at a vessel speed of 5 knots or 400 lb at 4 knots. The maximum "hull speed" of this boat is about 5.5 knots. Thus these foils can provide initial liftoff and final full above water support, to reach speeds well over 6.7 knots. For monohull sail boats the displacement wave and hull drag forces scale in such a way that geometric similitude prevails within the limits of the hull speed equations, thus larger vessels will require proportionally larger foils (in proportion to water line length LWL) and foil system dimensions, to operate in the foil-lifted mode desired.

An Olson 40 (10,300 lb displacement , 40 ft length, 11.0 ft beam) could utilize foils approximately twice the size of those above, for a liftoff condition at a speed of about 9.7 knots. The LWL of the Lido 14 is about 10.5 ft and the Olson 40 is about 33 ft. thus the hull speeds will be approximately SQRT(33/10.5)=1.77 times greater for the Olson 40 than the Lido 14. This gives a hull speed at about 9.7 knots, as above.

In certain embodiments of the invention, the foils are to be mounted at a distance below the boat waterline sufficient to ensure that they remain well-submerged when the boat is fully-lifted clear of the water, and sufficient to remain submerged in boat motion through seas with modest surface structure. Typically this requires that the amidships foils be mounted so as their mid support points are below the static waterline by a distance approximately equal to the half-width of the boat itself, or at the general position where the bottom of the conventional keel/bulb may be found in ordinary monohull sail boats. On the Lido 14 this may be at a depth of 3 ft below the lowest point of the hull, while the Olson 40 foils may be mounted at a depth of 6 ft below the low point of the hull. The bow and stern foils are to be similarly submerged.

What is claimed is:

1. A sail boat comprising:

a boat hull structure including a monohull and a deck;

a keel attached to the boat hull, said keel having sufficiently large mass to enhance boat stability, inhibit capsizing and permit righting of said boat if capsized;

a bow foil attached to a bow of the boat;

a keel foil attached to the keel of the boat;

a stern foil attached to the stern of the boat; wherein said bow foil comprises a port bow foil and a starboard bow foil and a first strut connecting said port bow foil to said boat and a second strut connecting said starboard bow foil to said boat;

wherein said first and second struts are moveable between a stowed position in which said port and starboard bow foils are out of the water and a deployed position in which said port and starboard bow foils are submerged in the water; and wherein said port and starboard bow foils are each separately adjustable as to their angle of attack.

2. The sail boat as recited in claim 1 further comprising:

means for adjusting the angle of attack of said bow foil.

3. The sail boat as recited in claim 1 further comprising:

means for adjusting the angle of attack of said keel foil.

4. The sail boat as recited in claim 1 further comprising:

means for adjusting the angle of attack of said stern foil.

5. The sail boat as recited in claim 1 further comprising:

means for adjusting the angle of attack of each of said bow foil, said keel foil and said stern foil.

6. The sail boat as recited in claim 5 wherein said bow, keel and stern foils have a sufficient lifting area to lift the boat completely out of the water for at least one angle of attack of said foils and for at least one value of boat speed.

7. The sail boat as recited in claim 1 further comprising and a foil adjuster for adjusting the angle of attach of each of said bow foil, said keel foil and said stern foil.

8. The sail boat as recited in claim 7 wherein said adjuster includes a controller connected to sense at least one parameter and to adjust at least one of the bow foil, keel foil and stern foil in response thereto.

9. The sail boat as recited in claim 8 wherein said controller includes a computer and said computer is connected to a motor for automatically adjusting said at least one of said bow foil, keel foil and stern foil.

10. The sail boat as recited in claim 9 wherein said at least one parameter is selected from the group consisting of boat angle, boat speed, and boat height above water.

11. The sail boat as recited in claim 2 wherein said means for adjusting the angle of attack includes means for supporting said bow foil for at least partial rotation about an axis which is mounted to a foil support, said foil support fixed in position when said foil is used to lift said boat.

12. The sail boat is recited in claim 3 wherein said means for adjusting the angle of attack of said keel foil includes means for supporting said foil on a keel structure for at least partial rotation about an axis which is mounted to said keel structure, said keel structure fixed in position when said foil is used to lift said boat.

13. The sail boat is recited in claim 4 wherein said means for adjusting the angle of attack includes means for supporting said stern foil for at least partial rotation about an axis which is mounted to a foil support, said foil support fixed in position when said foil is used to lift said boat.

14. The sail boat is recited in claim 5 wherein said means for adjusting the angle of attack of each of said bow foil, keel foil and stern foil includes means for supporting each of said bow foil, keel foil, and stern foil for at least partial rotation about an axis which is mounted to a fixed foil support, said foil support fixed in position when said foil is used to lift said boat.

15. A sail boat comprising:

a boat hull structure including a monohull and a deck;

a keel attached to the boat hull, said keel having sufficiently large mass to enhance boat stability, inhibit capsizing and permit righting of said boat if capsized;

a bow foil attached to a bow of the boat;

a keel foil attached to the keel of the boat;

a stern foil attached to the stern of the boat;

wherein said keel foil comprises a port and starboard keel foil, said port keel foil attached to a third strut and said starboard keel foil attached to a fourth strut and said third and fourth struts secured to said boat;

wherein said third and fourth struts are moveable between a stowed position in which said port and starboard keel foils are out of the water and a deployed position in which said port and starboard keel foils are submerged in the water; and said port and starboard keel foils are each separately adjustable as to their angle of attack.

16. The sail boat as recited in claim 15 wherein said third and fourth struts are moveable to present a variable angle of attack to water flow and thus provide sidewise forces to the boat.

17. The sail boat as recited in claim 15 wherein said stern foil comprised a ladder foil arrangement comprising a first and second substantially horizontal foil.

18. The sail boat as recited in claim 17, further comprising a fifth and sixth strut attached to port and starboard ends of each of said first and second horizontal foils of said ladder foil arrangement.

19. The sail boat as recited in claim 18 further comprising wherein said ladder foil arrangement is moveable between a stowed position in which first and second horizontal foils are out of the water and a deployed position in which said first and second horizontal foils are submerged in the water.

20. The sail boat as recited in claim 19 wherein said fifth and sixth struts are moveable to serve as a rudder.

* * * * *